US008851023B2

(12) United States Patent
Effert et al.

(10) Patent No.: US 8,851,023 B2
(45) Date of Patent: Oct. 7, 2014

(54) CONTINUOUS STEAM GENERATOR

(75) Inventors: Martin Effert, Erlangen (DE); Andreas Schneider, Bammersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 621 days.

(21) Appl. No.: 13/127,340

(22) PCT Filed: Oct. 28, 2009

(86) PCT No.: PCT/EP2009/064205

§ 371 (c)(1),
(2), (4) Date: May 3, 2011

(87) PCT Pub. No.: WO2010/052158

PCT Pub. Date: May 14, 2010

(65) Prior Publication Data

US 2011/0214622 A1 Sep. 8, 2011

(30) Foreign Application Priority Data

Nov. 10, 2008 (EP) ..... 08019643

(51) Int. Cl.

| | |
|---|---|
| ***F22B 7/00*** | (2006.01) |
| ***F22B 29/06*** | (2006.01) |
| ***F22B 37/62*** | (2006.01) |
| ***F22B 21/34*** | (2006.01) |

(52) U.S. Cl.

CPC ..... *F22B 21/343* (2013.01); *F22B 29/061* (2013.01); *F22B 37/62* (2013.01)

USPC ..... 122/235.12; 122/235.14; 122/235.15; 122/235.23; 122/136 R

(58) Field of Classification Search

USPC ..... 122/136 R, 235.12, 235.14, 235.15, 122/235.23

See application file for complete search history.

(56) References Cited

U.S. PATENT DOCUMENTS

| | | | | |
|---|---|---|---|---|
| 3,095,699 | A * | 7/1963 | Baver | 60/783 |
| 3,288,117 | A * | 11/1966 | Schroedter | 122/406.4 |
| 3,320,934 | A * | 5/1967 | Doell et al. | 122/406.4 |
| 4,075,979 | A * | 2/1978 | Michel | 122/235.12 |
| 4,864,973 | A * | 9/1989 | Lieb et al. | 122/510 |
| 2008/0257282 | A1 * | 10/2008 | Effert et al. | 122/1 R |
| 2011/0197830 | A1 * | 8/2011 | Bruckner et al. | 122/406.4 |
| 2011/0203536 | A1 * | 8/2011 | Effert et al. | 122/7 R |

FOREIGN PATENT DOCUMENTS

| | | |
|---|---|---|
| CN | 1254408 A | 5/2000 |
| DE | 1244803 B | 7/1967 |
| DE | 2557427 A1 | 6/1977 |

(Continued)

*Primary Examiner* — Kang Hu
*Assistant Examiner* — Nathaniel Herzfeld

(57) ABSTRACT

A continuous steam generator with a combustion chamber having a number of burners for fossil fuel and an outside wall composed of steam generator pipes that are welded to each other gas-tight is provided. A vertical gas flue is connected downstream of the combustion chamber on the hot gas side in an upper area via a horizontal gas flue, wherein a part of the outside wall facing the vertical gas flue and below the horizontal gas flue is inclined inward and thus forms a nose projecting into the combustion chamber with the bottom of the adjacent horizontal gas flue. Support pipes are connected downstream of at least one part of the steam generator pipes of the nose at the upper end thereof on the flow medium side, wherein the support pipes are guided substantially vertically to the lower end of the nose.

4 Claims, 1 Drawing Sheet

(56) References Cited

FOREIGN PATENT DOCUMENTS

| | | | |
|---|---|---|---|
| EP | 1544540 | A1 | 6/2005 |
| EP | 1607680 | A1 | 12/2005 |
| GB | 1244128 | A | 8/1971 |
| JP | 52076501 | A | 6/1977 |
| JP | 2000028106 | A | 1/2000 |
| JP | 2006317023 | A | 11/2006 |

* cited by examiner

CONTINUOUS STEAM GENERATOR

CROSS REFERENCE TO RELATED APPLICATIONS

This application is the US National Stage of International Application No. PCT/EP2009/064205 filed Oct. 28, 2009, and claims the benefit thereof. The International Application claims the benefits of European Patent Application No. 08019643.9 EP filed Nov. 10, 2008. All of the applications are incorporated by reference herein in their entirety.

FIELD OF INVENTION

The invention relates to a continuous steam generator comprising a combustion chamber having a number of burners for fossil fuel and an outside wall composed of steam generator pipes that are welded to each other in a gas-tight manner, wherein a vertical gas flue is connected downstream of the combustion chamber on the hot gas side in an upper area through a horizontal gas flue, wherein a part of the outside wall facing the vertical gas flue and below the horizontal gas flue is inclined inward and thus forms a nose projecting into the combustion chamber.

BACKGROUND OF INVENTION

In a fossil fired steam generator, the energy of a fossil fuel is used to produce superheated steam which in a power plant, for example, can then be supplied to a steam turbine for power generation.

Particularly at the steam temperatures and pressures prevalent in a power plant environment, steam generators are normally implemented as water tube boilers, i.e. the water supplied flows in a number of tubes which absorb energy in the form of radiant heat of the burner flames and/or by convection from the flue gas produced during combustion.

In the region of the burners, the steam generator pipes here usually constitute the combustion chamber wall by being welded together in a gas-tight manner. In other areas downstream of the combustion chamber on the flue gas side, steam generator pipes disposed in the waste gas flue can also be provided.

Fossil fired steam generators can be categorized on the basis of a large number of criteria: steam generators may in general be designed as natural circulation, forced circulation or continuous steam generators. In a continuous steam generator, the heating of a number of steam generator pipes results in complete evaporation of the flow medium in the steam generator pipes in one pass. Once evaporated, the flow medium—usually water—is fed to superheater tubes downstream of the steam generator pipes where it is superheated.

Strictly speaking, this description is valid only at partial loads with subcritical pressure of water ($P_{Kri}$≈221 bar) in the evaporator—at which there is no temperature at which water and steam can be present simultaneously and therefore also no phase separation is possible. However, for the sake of clarity, this representation will be used consistently in the following description. The position of the evaporation end point, i.e. the location at which the water content of the flow is completely evaporated, is variable and dependent on the operating mode. During full load operation of a continuous steam generator of this kind, the evaporation end point is, for example, in an end region of the steam generator pipes, so that the superheating of the evaporated flow medium begins even in the steam generator pipes.

In contrast to a natural or forced circulation steam generator, a continuous steam generator is not subject to pressure limiting, so that it can be designed for main steam pressures well above the critical pressure of water.

During light load operation or at startup, a continuous steam generator of this kind is usually operated with a minimum flow of flow medium in the steam generator pipes in order to ensure reliable cooling of the steam generator pipes. For this purpose, particularly at low loads of for example less than 40% of the design load, the pure mass flow through the evaporator is usually no longer sufficient to cool the steam generator pipes, so that an additional throughput of flow medium is superimposed in a circulatory manner on the flow medium passing through the evaporator. The operatively provided minimum flow of flow medium in the steam generator pipes is therefore not completely evaporated in the steam generator pipes during startup or light load operation, so that unevaporated flow medium, in particular a water-steam mixture, is still present at the end of the evaporator pipe.

However, as the superheater tubes mounted downstream of the steam generator pipes of the continuous steam generator and usually only receiving flow medium after it has flowed through the combustion chamber walls are not designed for a flow of unevaporated flow medium, continuous steam generators are generally designed such that water is reliably prevented from entering the superheater tubes even during startup or light load operation. To achieve this, the steam generator pipes are normally connected to the superheater tubes mounted downstream thereof via a moisture separation system. The moisture separator is used to separate the water-steam mixture exiting the steam generator pipes during startup or light load operation into water and steam. The steam is fed to the superheater tubes mounted downstream of the moisture separator, whereas the separated water is returned to the steam generator pipes e.g. via a circulating pump or can be drained off via a flash tank.

Based on the flow direction of the gas stream, steam generators can also be subdivided, for example, into vertical and horizontal types. In the case of fossil fired steam generators of vertical design, a distinction is usually drawn between single-pass and two-pass boilers.

In the case of a single-pass or tower boiler, the flue gas produced by combustion in the combustion chamber always flows vertically upward. All the heating surfaces disposed in the flue gas flue are above the combustion chamber on the flue gas side. Tower boilers offer a comparatively simple design and simple control of the stresses produced by the thermal expansion of the tubes. In addition, all the heating surfaces of the steam generator pipes disposed in the flue gas flue are horizontal and can therefore be completely dewatered, which may be desirable in frost-prone environments.

In the case of the two-pass boiler, a horizontal gas flue leading into a vertical gas flue is mounted in an upper region downstream of the combustion chamber on the flue gas side. In said second vertical gas flue, the gas usually flows vertically from top to bottom. Therefore, in the two-pass boiler, multiple flow baffling of the flue gas takes place. Advantages of this design are, for example, the lower installed height and the resulting reduced manufacturing costs.

In a steam generator embodied as a two-pass boiler the walls are generally arranged suspended in a boiler framework, so that upon being heated during operation it can expand freely downwards. The two-pass stem generator here generally comprises four walls per flue, where it should be ensured that the walls of the individual flues expand evenly, as impermissible tensions can otherwise occur in the connections of the walls.

Frequently, two-pass boilers of this kind further comprise a so-called combustion chamber nose. This nose is a projection, which is formed from the combustion chamber wall inclined inwards at the transition to the horizontal gas flue and the bottom of the horizontal gas flue. A combustion chamber nose of this kind improves the flow of flue gas at the transition to the horizontal gas flue.

It is however disadvantageous that the pipework of the combustion chamber rear wall, that is the wall facing the horizontal gas flue and the second vertical gas flue is interrupted by the combustion chamber nose. The weight of the rear wall must thus generally be passed into the boiler framework between the upper and lower end of the nose by means of a special construction in such a way that upon heating or loading—for example as a result of internal pressure, ash build-up or its own weight—the rear wall moves to the same degree as the other walls. To date there have been various approaches to the solution of this problem:

For example the upper and the lower end of the nose can be effected by means of flue rods and springs or so-called constant hangers, which despite changes to the spring deflection always transfer approximately the same force. A construction of this kind thus adapts to the differential expansion of the walls. Different loads for example as a result of changing internal pressure or ash build-up do however give rise to high levels of tension at the connections to the side walls. In addition, these constant hangers are costly.

A further possibility lies in the in the simple continuation of the pipes of the lower combustion chamber in a vertical direction as far as the suspension point in the boiler framework. The connection from the lower end of the nose to the boiler framework thus has approximately the same temperatures as the side walls and the front wall. The pipework of the nose must though then be embodied in separate form, which means an additional outlay in terms of connecting pipes.

A further possibility lies in dividing the pipes of the combustion chamber rear wall at the lower end of the nose on the flow medium side, so that a part of pipes are routed into the pipework of the nose, another part parallel to this vertically to the boiler framework. Therefore, however, only part of the pipes and of the flow medium is available to the nose, which can under certain circumstances lead to inadequate cooling of the nose, as the latter has a comparatively high heat input through its exposed position in the combustion chamber. In contrast to this, the heat input for the support pipes removed and routed vertically upwards is correspondingly lower, which can give rise to problems in relation to the distribution of the mass flow. All wall pipes above the nose and the support pipes should if possible have the same steam temperatures at the outlet. Furthermore a laborious transition into the nose pipework for example by changing the division of the pipes or other pipe geometry is required.

SUMMARY OF INVENTION

An object of the invention is to specify a continuous steam generator of the above-mentioned type which has a simple design while providing a particularly long service life.

The object is achieved in that a number of support pipes on the flow medium side are downstream of at least part of the steam generator pipes of the nose at their upper end, which are essentially vertically routed to the lower end of the nose.

The invention is based on the idea that a particularly simple technical construction of a continuous steam generator in a two-pass configuration would be possible if the suspension of the rear wall in particular in the area of the nose could be implemented by means of vertically arranged support pipes and thus no additional springs or constant hangers are necessary. With view to operational safety it should be ensured that adequate cooling of the nose itself takes place in light of the high heat inputs. Against this background the largest possible part of the pipes of the lower area of the rear wall of the combustion chamber should accordingly be routed into the nose, so that almost the entire media flow is available for cooling of the nose. Then, however, no further pipes are available as support pipes for the rear wall. Complicated distribution systems or separate pipework of the nose as an aid in this case do though again mean additional technical constructional outlay.

To solve these apparently contradictory design objectives, at the upper end of nose only, at least a part of the pipes should accordingly be routed from top to bottom against the otherwise customary direction of flow of the pipework of the combustion chamber. These pipes can then serve as support pipes for the rear wall in the case of connection to the lower end of the nose.

In an advantageous embodiment, a number of support pipes are downstream on the flow medium side of a further part of the steam generator pipes of the nose at their upper end, which are essentially routed vertically to a cover of the combustion chamber. Support pipes are also thereby available, which connect the nose and lower part of the combustion chamber linked to the nose with the cover, and thus serve to ensure reliable suspension. As flow medium flows through these support pipes, they expand just as the remaining parts of the combustion chamber, and an even expansion of all four combustion chamber walls takes place and no impermissible tensions arise at the connections of the walls.

In a further advantageous embodiment all the steam generator pipes of the part of the surrounding wall facing the vertical gas flue on the flow medium side steam generator pipes are downstream of the nose. It is thereby ensured that the entire flow medium flows out of the combustion chamber rear wall or its lower steam generator pipes into the nose, and adequate cooling of the nose is thus ensured. As a result of its exposed position in the interior of the combustion chamber, the nose has a particularly high heat input.

Advantageously, a collector arranged in the area of the lower end of the nose is downstream of the support pipes routed to the lower end of the nose. This collector can then collect the flow medium branched for the support pipes and make it further available to the system via an appropriate redirection.

To this end a number of connecting pipes are downstream of the support pipes routed to the lower end of the nose, which lead into pipes downstream of the steam generator pipes of the upper area of the combustion chamber. The media flow branched for the support pipes is thus switched parallel to the further steam generator pipes of the upper area of the combustion chamber and fed into the system once more. Complete usage of the media flows of the support pipes is thus possible.

The advantages connected with the invention lie in particular in the fact that as a result of the downstream location of a number of support pipes on the flow medium side, which are essentially routed vertically to the lower end of the nose, on at least one part of the steam generator pipes of the nose at their upper end, a particularly simple technical construction coupled at the same time with a high level of operational reliability of the steam generator is possible. On the one hand, steam generator pipes are fully employed for load take-up by the boiler framework, and no separate constructions such as for example constant hangers are used, while on the other hand by means of this construction the entire water-steam flow of the rear wall is available for the nose, and adequate cooling of the combustion chamber nose is ensured. Furthermore, largely similar temperatures obtain in the pipe walls, without a separate and laborious drilling of the nose or a complicated transition with changes in the geometry of the pipes being necessary.

BRIEF DESCRIPTION OF THE DRAWINGS

An exemplary embodiment of the invention will now be explained in greater detail with reference to a drawing, in which.

Identical parts are provided with the same reference characters in both figures.

DETAILED DESCRIPTION OF INVENTION

Figure 1:
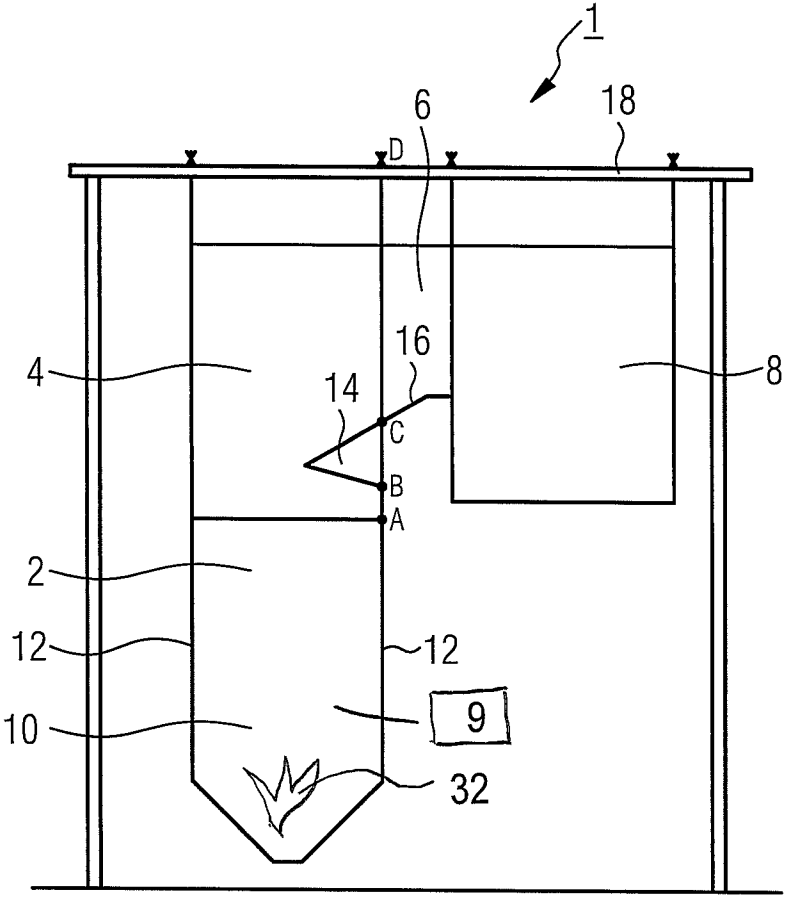
FIG. 1 schematically illustrates a continuous steam generator of two-pass design.

The continuous steam generator 1 according to FIG. 1 comprises a combustion chamber 2 embodied as a vertical gas flue, which is downstream of a horizontal gas flue 6 in an upper area 4. A further vertical gas flue 8 joins the horizontal gas flue 6.

In the lower region 10 of the combustion chamber 2 a number of burners 32 (not shown in greater detail) are provided which combust liquid or solid fuel in the combustion chamber. The surrounding wall 12 of the combustion chamber 2 is formed of steam generator pipes welded together in a gas-tight manner into which a flow medium—usually water—is pumped by a pump 9 (not shown in greater detail), said flow medium being heated by the heat produced by the burners. In the lower region 10 of the combustion chamber 2, the steam generator pipes can be oriented either spirally or vertically. In the case of a spiral arrangement, although comparatively greater design complexity is required, the resulting asymmetries between parallel tubes are comparatively lower than with a vertically tubed combustion chamber 2.

To improve flue gas guidance the continuous steam generator 1 further comprises a nose 14, which passes directly into the bottom 16 of the horizontal gas flue 6 and protrudes into the combustion chamber 2. As a result of its exposed position in the interior of the combustion chamber 2, the nose 14 has a particularly high heat input auf and should thus have a particularly high throughput of flow medium, so that adequate cooling of the nose 14 is ensured.

The flues of the steam generator 1 are arranged suspended in a framework 18, so that the flues of the steam generator 1 can expand downwards unhindered in the vent of heating. In order that the most even possible expansion of all walls in particular of the combustion chamber 2 of the steam generator 1 takes place, all the surrounding walls 12 of the combustion chamber 2 should have approximately the same temperature, so that an even heating and expansion ensue. This is most simply effected in that the entire support structure consists of steam generator pipes.

Figure 2:
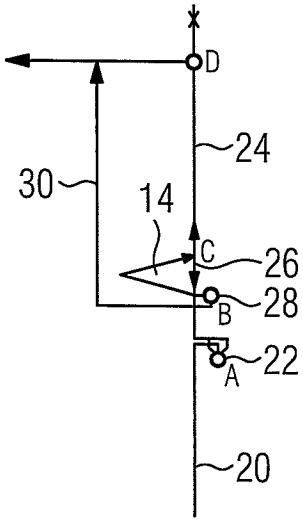
FIG. 2 shows a schematic representation of the interconnection of the individual steam generator pipes of the combustion chamber wall.

In order on the one hand to enable a support structure in particular of the part of the surrounding wall 12 of the combustion chamber 2 facing the horizontal gas flue 6, and on the other hand to ensure adequate cooling of the nose 14, the steam generator pipes of the surrounding wall 12 of the combustion chamber 2 facing the horizontal gas flue 6 are interconnected as shown in FIG. 2.

The steam generator pipes 20 of the lower area of the rear wall of the combustion chamber 2 initially lead into a collector 22 at point A (for the geometric position of points A to D these are also shown in FIG. 1) and are further routed to point B. Here the entire mass flow is initially routed from A into the pipework of the nose 14 routed. The entire mass flow from the steam generator pipes 20 of the combustion chamber rear wall is thus available for cooling of the nose.

At point C the mass flow is divided, one part of the pipes runs as support pipes 24 to point D on the cover of the steam generator, a further part is routed from point C as support pipes 26 downwards to point B. The support pipes 24, 26 thus form a continuous support structure for the rear wall of the combustion chamber from steam generator pipes. The support pipes 26 lead into a collector 28 at point B and the media flow is fed via a connecting line 30 to the pipes or a steam separator system downstream of the point B. Use of the media flows from the support pipes 26 is thus also possible.

The invention claimed is:

1. A continuous steam generator, comprising:

a combustion chamber with a plurality of burners for fossil fuel;

a surrounding wall of the combustion chamber formed of steam generator pipes welded together in a gas-tight manner;

a horizontal gas flue;

a vertical gas flue connected downstream of the combustion chamber on a hot gas side in an upper area by means via the horizontal gas flue, wherein a part of the surrounding wall facing the vertical gas flue and below the horizontal gas flue is inclined inwards and thereby forms, with a bottom of the adjacent horizontal gas flue a nose projecting into the combustion chamber, wherein the steam generator pipes are arranged such that an entire mass flow is routed out of the part of the surrounding wall facing the vertical gas flue into the nose, and wherein support pipes are connected downstream of at least one part of the steam generator pipes of the nose at an upper end of the nose on a flow medium side, the support pipes carrying the entire mass flow being routed essentially vertically into a first collector at a lower end of the nose, wherein the entire mass flow is divided at a second point downstream of the steam generator pipes into two parts of the support pipes, one part of the support pipes are routed essentially vertically to a third point on the cover of the steam generator, and a further part is routed from the second point downwards into the first collector.

2. The continuous steam generator as claimed in claim 1, wherein steam generator pipes of the nose are connected downstream of all steam generator pipes of the part of the surrounding wall facing the vertical gas flue on the flow medium side.

3. The continuous steam generator as claimed in claim 1, further comprising:

a second collector arranged in an area of the lower end of the nose downstream of the support pipes routed to the lower end of the nose.

4. The continuous steam generator as claimed in claim 1, further comprising:

a plurality of connecting pipes connected downstream of the support pipes routed to the lower end of the nose, wherein the connecting pipes lead into pipes downstream of the steam generator pipes of the upper area of the combustion chamber.

* * * * *